US010982372B2

(12) United States Patent
Dedow et al.

(10) Patent No.: US 10,982,372 B2
(45) Date of Patent: Apr. 20, 2021

(54) WASHING MACHINE APPLIANCES AND METHODS FOR SETTING PLASTER SPEED

(71) Applicant: Haier US Appliance Solutions, Inc., Wilmington, DE (US)

(72) Inventors: Gregory Allen Dedow, Louisville, KY (US); Martin Ortega Brena, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 219 days.

(21) Appl. No.: 16/149,309

(22) Filed: Oct. 2, 2018

(65) Prior Publication Data

US 2020/0102684 A1 Apr. 2, 2020

(51) Int. Cl.

| | |
|---|---|
| ***D06F 23/02*** | (2006.01) |
| ***D06F 33/40*** | (2020.01) |
| ***D06F 33/48*** | (2020.01) |
| ***D06F 34/18*** | (2020.01) |
| ***D06F 37/22*** | (2006.01) |

(Continued)

(52) U.S. Cl.

CPC ..... *D06F 37/304* (2013.01); *D06F 23/02* (2013.01); *D06F 33/40* (2020.02); *D06F 33/48* (2020.02); *D06F 34/18* (2020.02); *D06F 37/22* (2013.01); *D06F 37/302* (2013.01); *D06F 39/08* (2013.01); *D06F 2103/26* (2020.02); *D06F 2103/44* (2020.02); *D06F 2105/48* (2020.02); *D06F 2202/06* (2013.01); *D06F 2202/12* (2013.01); *D06F 2204/06* (2013.01); *D06F 2204/10* (2013.01)

(58) Field of Classification Search

CPC ..... D06F 23/02; D06F 33/40; D06F 33/48; D06F 34/18; D06F 37/22; D06F 37/302; D06F 37/304; D06F 39/08; D06F 2103/26; D06F 2103/44; D06F 2105/48; D06F 2202/06; D06F 2202/12; D06F 2204/06; D06F 2204/10

USPC ..... 8/158, 159; 68/12.01, 12.02, 12.04, 68/12.06, 12.16

See application file for complete search history.

(56) References Cited

U.S. PATENT DOCUMENTS

| | | | |
|---|---|---|---|
| 6,374,444 | B2 | 4/2002 | Skrippek et al. |
| 7,530,133 | B2 | 5/2009 | Mitts |

(Continued)

FOREIGN PATENT DOCUMENTS

| | | | |
|---|---|---|---|
| EP | 1857583 | A1 | 11/2007 |
| EP | 2765230 | A1 | 8/2014 |

(Continued)

*Primary Examiner* — Levon J Shahinian

(74) *Attorney, Agent, or Firm* — Dority & Manning, P.A.

(57) ABSTRACT

A washing machine operation and method for setting a plaster speed are provided herein. The washing machine appliance may include a tub, a wash basket, a valve, a nozzle, a measurement device, a motor, and a controller. The wash basket may be rotatably mounted within the tub to receive a load of one or more articles. The nozzle may be configured for flowing liquid from the valve into the tub. The measurement device may detect movement of the tub. The motor may be in mechanical communication with the wash basket. The motor may be configured for selectively rotating the wash basket within the tub. The controller may be in operative communication with the valve, the motor, and the measurement device.

14 Claims, 7 Drawing Sheets

(51) Int. Cl.

| | |
|---|---|
| ***D06F 37/30*** | (2020.01) |
| ***D06F 39/08*** | (2006.01) |
| *D06F 105/48* | (2020.01) |
| *D06F 103/26* | (2020.01) |
| *D06F 103/44* | (2020.01) |

(56) References Cited

U.S. PATENT DOCUMENTS

| | | | | |
|---|---|---|---|---|
| 8,122,549 | B2 | 2/2012 | Park et al. | |
| 8,176,798 | B2 | 5/2012 | Ashrafzadeh et al. | |
| 8,215,134 | B2 | 7/2012 | Ashrafzadeh et al. | |
| 8,381,569 | B2 | 2/2013 | Lilie et al. | |
| 2006/0242768 | A1 | 11/2006 | Zhang et al. | |
| 2011/0005339 | A1* | 1/2011 | Ashrafzadeh ..... | D06F 33/00 73/862.192 |
| 2014/0215725 | A1 | 8/2014 | Paglia et al. | |

FOREIGN PATENT DOCUMENTS

| | | | |
|---|---|---|---|
| EP | 1995366 | B1 | 5/2015 |
| JP | 2010194078 | A | 9/2010 |
| JP | 2013027448 | A | 2/2013 |

* cited by examiner

WASHING MACHINE APPLIANCES AND METHODS FOR SETTING PLASTER SPEED

FIELD OF THE INVENTION

The present subject matter relates generally to washing machine appliances, and more particularly to washing machine appliances having features and methods for determining and setting a suitable plaster speed.

BACKGROUND OF THE INVENTION

Washing machine appliances generally include a tub for containing water or wash fluid (e.g., water and detergent, bleach, or other wash additives). A basket is rotatably mounted within the tub and defines a wash chamber for receipt of articles for washing. During normal operation of such washing machine appliances, the wash fluid is directed into the tub and onto articles within the wash chamber of the wash basket. The wash basket or an agitation element can rotate at various speeds to agitate articles within the wash chamber, to wring wash fluid from articles within the wash chamber, etc. Washing machine appliances include vertical axis washing machine appliances (i.e., top-loading washing machine appliances) and horizontal axis washing machine appliances (i.e., front-loading washing machine appliances), where "vertical axis" and "horizontal axis" refer to the rotation axis of the wash basket within the tub.

In conventional washing machine appliances, a spin cycle is often performed at a predetermined "plaster" speed at which the clothing articles of a given load should be pressed against the wall of the wash basket. This is generally done in order to aid water shedding from the articles. The plaster speed may be set, for instance, by a user or by selecting a specified load size or article type. However, such appliances and methods often fail to account for the variations in unique loads or collections of articles within a wash basket. For instance, it may be difficult to know in advance how an actual load (e.g., individual load) of articles provided by a user will be affected during a given washing operation. The provided articles may be a unique mixture of fabrics of varying volumes and mass. Moreover, it may be difficult for a user to guess what setting is appropriate for an individual load. Thus, a predetermined plaster speed for a spin cycle may be inappropriate for certain loads.

Undesirable operation may result from an inappropriate spin cycle. For instance, if the spin cycle is too brief, the articles within wash basket will remain excessively wet (e.g., such that water continues to drip from the articles when removed from the washing machine appliance). If the spin cycle is too long, excessive energy may be expended by the washing machine appliance. In addition, undesired noise may be generated, especially if a pump assembly runs dry (i.e., continues to pump without any water or liquid to flow therethrough).

Accordingly, improved methods and assemblies for controlling basket spin (e.g., spin cycles) of a washing machine appliance are desired. In particular, it would be advantageous to provide methods and assemblies to monitor and influence basket plaster speed based on one or more detected characteristics of an individual load.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The method may include flowing a volume of liquid into a tub, draining liquid from the tub, and spinning a wash basket within the tub from an initial speed after draining liquid from the tub. The method may also include measuring movement of the tub following spinning the wash basket at the initial speed. Measuring movement may include detecting movement of the tub as a plurality of amplitudes, and evaluating a change in amplitude from the plurality of amplitudes. The method may further include determining a plaster speed for the load of one or more articles based on the change in amplitude, and spinning the wash basket at the determined plaster speed.

In another exemplary aspect of the present disclosure, a washing machine appliance is provided. The washing machine appliance may include a tub, a wash basket, a valve, a nozzle, a measurement device, a motor, and a controller. The wash basket may be rotatably mounted within the tub to receive a load of one or more articles. The nozzle may be configured for flowing liquid from the valve into the tub. The measurement device may detect movement of the tub. The motor may be in mechanical communication with the wash basket. The motor may be configured for selectively rotating the wash basket within the tub. The controller may be in operative communication with the valve, the motor, and the measurement device. The controller may be configured to initiate a washing operation. The washing operation may include flowing a volume of liquid into the tub, draining liquid from the tub, and spinning the wash basket from an initial speed after draining liquid from the tub. The washing operation may further include measuring movement of the tub following spinning the wash basket at the initial speed. Measuring movement may include detecting movement of the tub as a plurality of amplitudes at the measurement device, and evaluating a change in amplitude from the plurality of amplitudes. The washing operation may further include determining a plaster speed for the load of one or more articles based on the change in amplitude, and spinning the wash basket at the determined plaster speed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
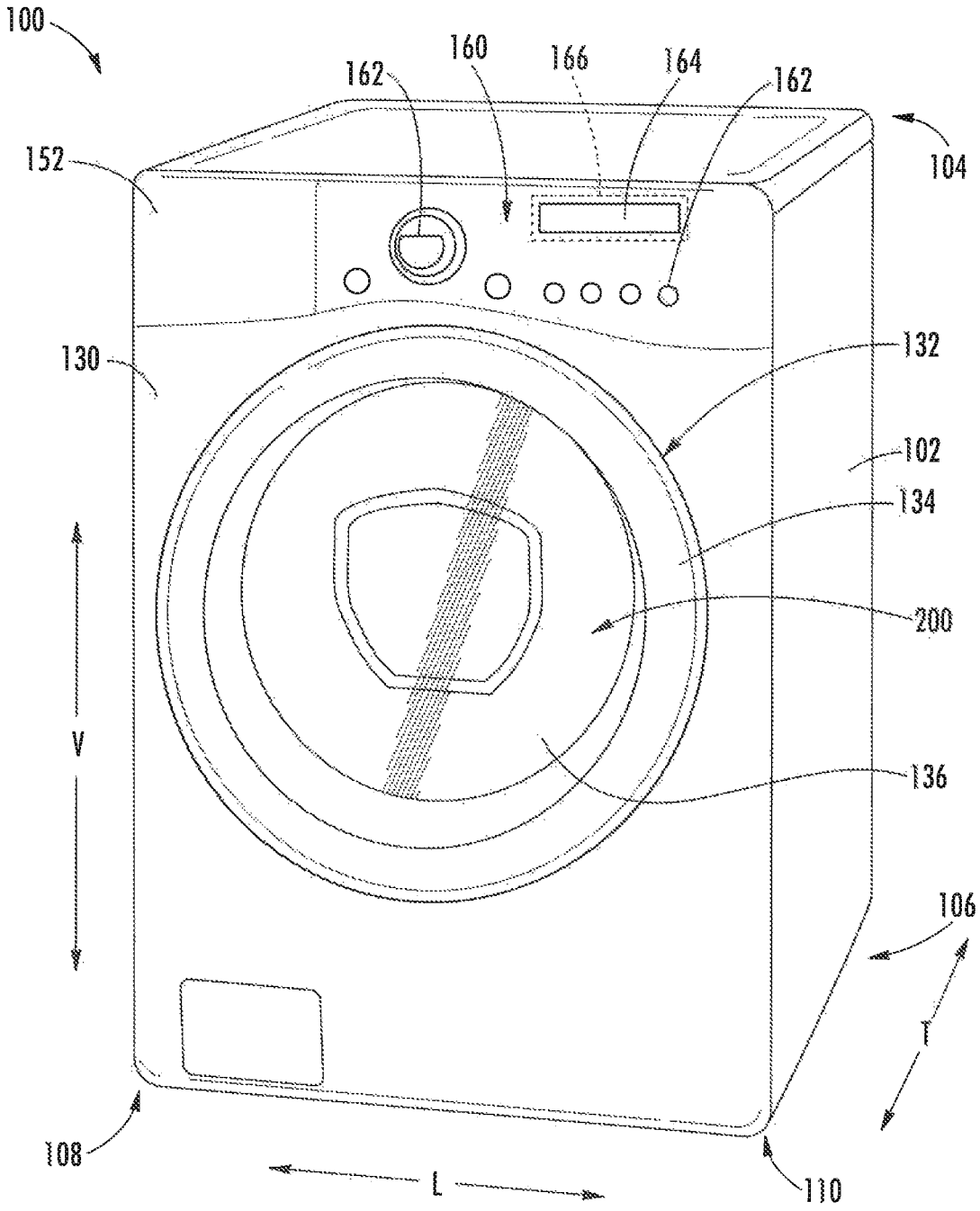
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Furthermore, as used herein, terms of approximation, such as "approximately," "substantially," or "about," refer to being within a ten percent margin of error of the measured units.

Figure 2:
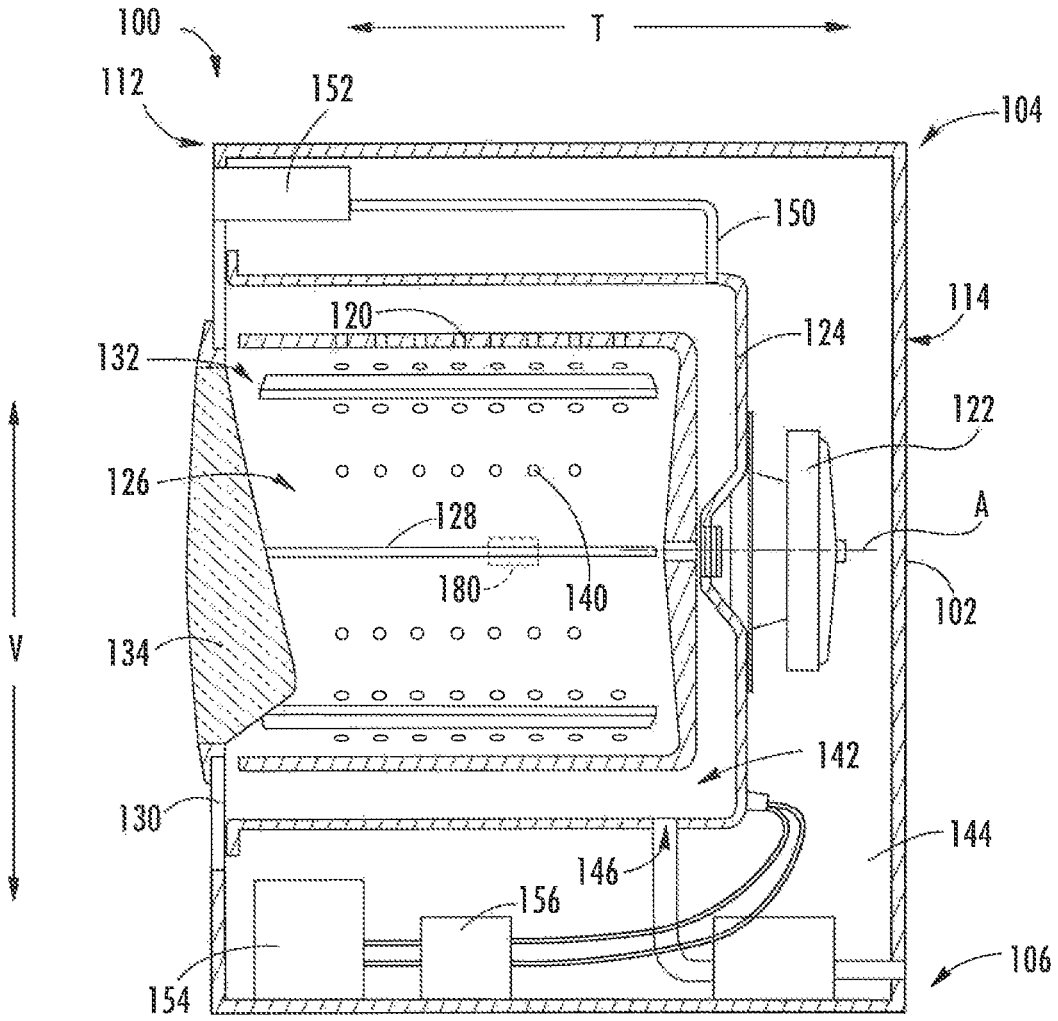
FIG. 2 provides a cross-sectional side view of the exemplary washing machine appliance.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Tub 124 is substantially fixed relative to cabinet 102 such that it does not generally rotate or translate relative to cabinet 102 (e.g., apart from vibrations or twisting indirectly induced by movement of other elements within cabinet 102).

A wash basket 120 is received within tub 124 and defines a wash chamber 126 that is configured for receipt of articles for washing. More specifically, wash basket 120 is rotatably mounted within tub 124 such that it is rotatable about a rotation axis A. According to the illustrated embodiment, the rotation axis A is substantially parallel to the transverse direction T. In this regard, washing machine appliance 100 is generally referred to as a "horizontal axis" or "front-loading" washing machine appliance 100. However, it should be appreciated that aspects of the present subject matter may be used within the context of a washing machine appliances having a different configuration that that illustrated in FIGS. 1 through 3.

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation cycle, rinse cycle, spin cycle, etc. of washing machine appliance 100). According to the illustrated embodiment, motor assembly 122 is a pancake motor. However, it should be appreciated that any suitable type, size, or configuration of motor may be used to rotate wash basket 120 according to alternative embodiments.

In some embodiments, cabinet 102 also includes a front panel 130 that defines an opening 132 that permits user access to wash basket 120 of tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a tub 124 and a closed position (FIG. 1) prohibiting access to tub 124.

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle may extend between tub 124 and the front panel 130 about the opening 132 covered by door 134, further sealing tub 124 from cabinet 102.

Referring again to FIG. 2, wash basket 120 also defines a plurality of perforations 140 in order to facilitate fluid communication between an interior of basket 120 and tub 124. A sump 142 is defined by tub 124 at a bottom of tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. A pump assembly 144 is located beneath tub 124 for gravity assisted flow when draining tub 124 (e.g., via a drain 146). Pump assembly 144 is also configured for recirculating wash fluid within tub 124.

Figure 3:
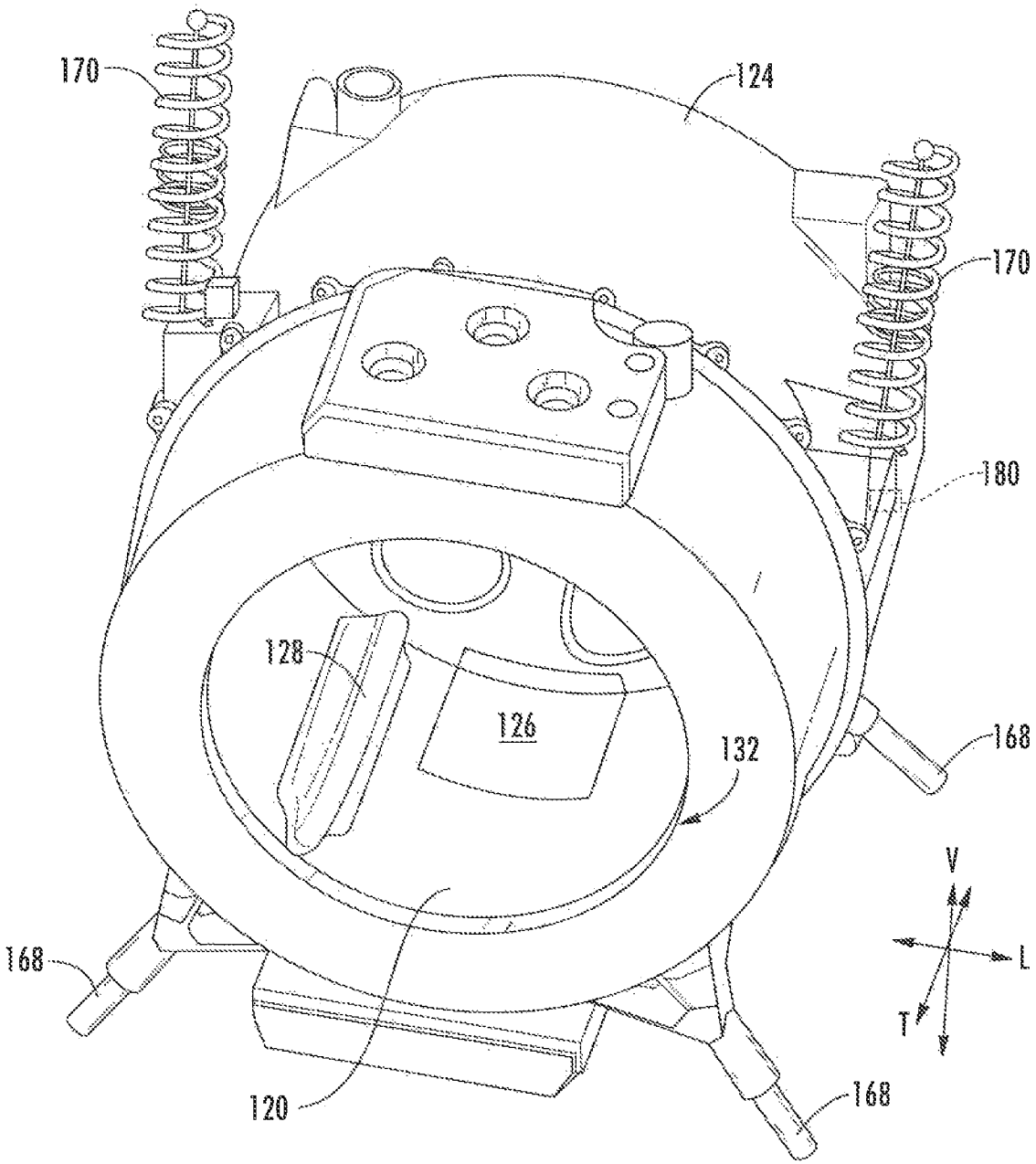
FIG. 3 provides a perspective view of a portion of the exemplary washing machine appliance, wherein the cabinet has been removed for clarity.
Figure 4:
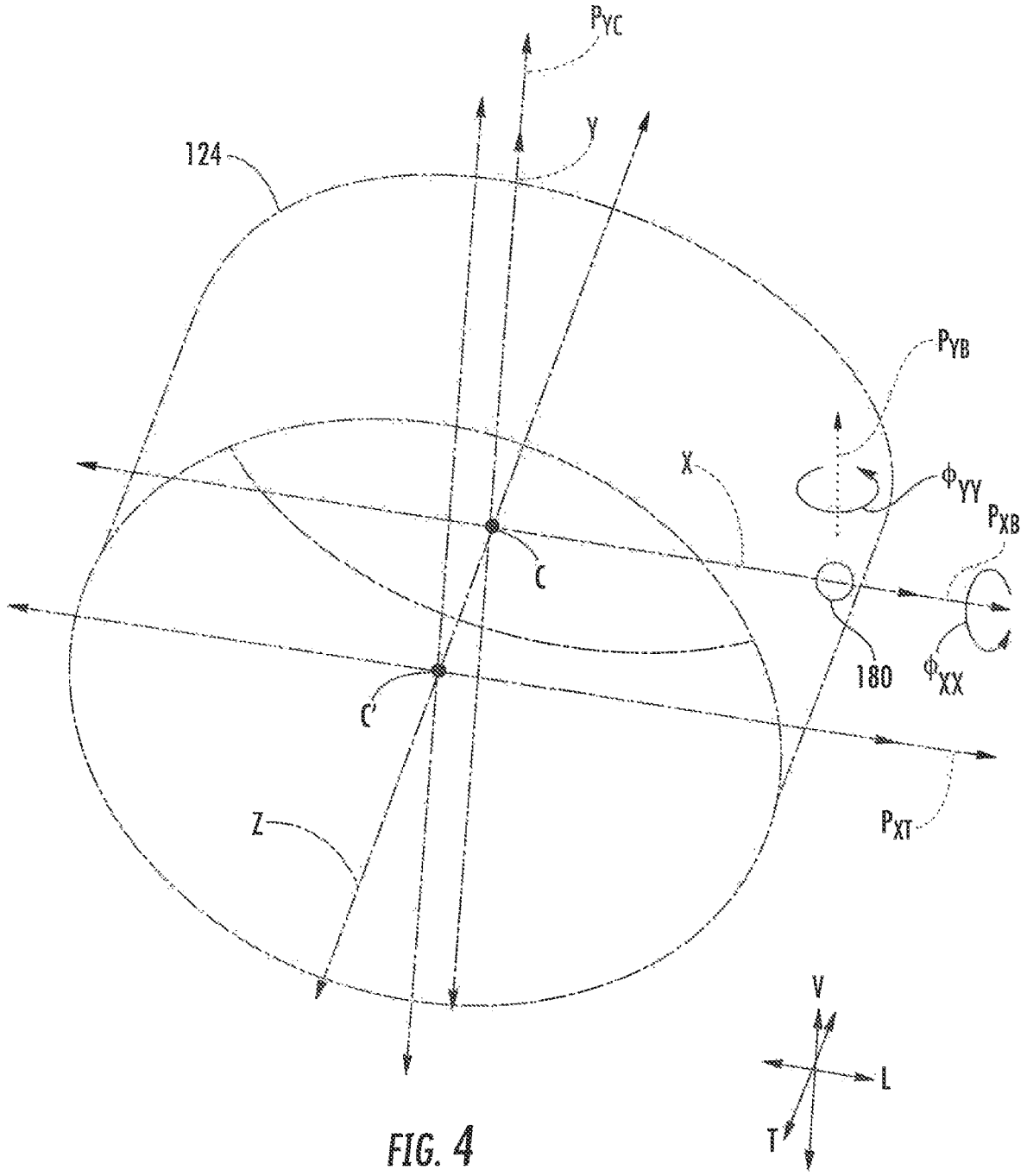
FIG. 4 provides a schematic perspective view of components of a washing machine appliance in accordance with exemplary embodiments of the present disclosure.
Figure 5:
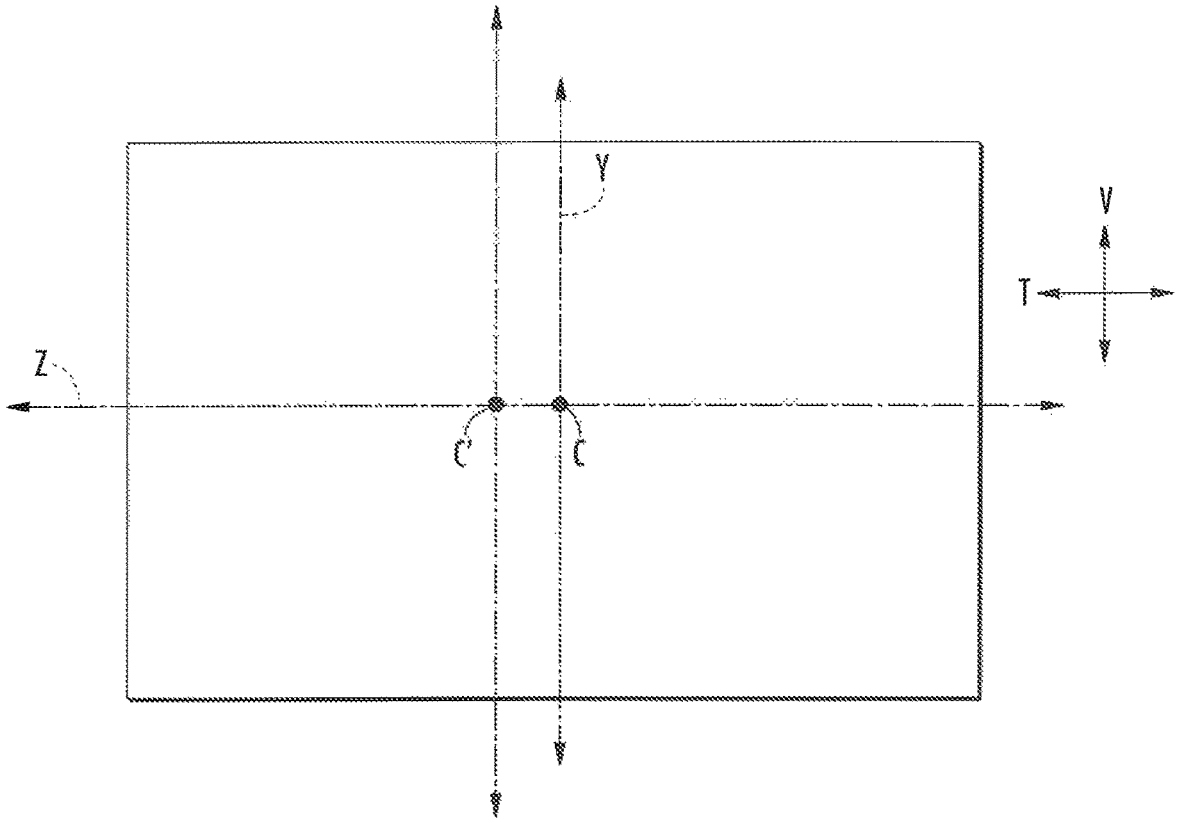
FIG. 5 provides a schematic side view of components of a washing machine appliance in accordance with exemplary embodiments of the present disclosure.
Figure 6:
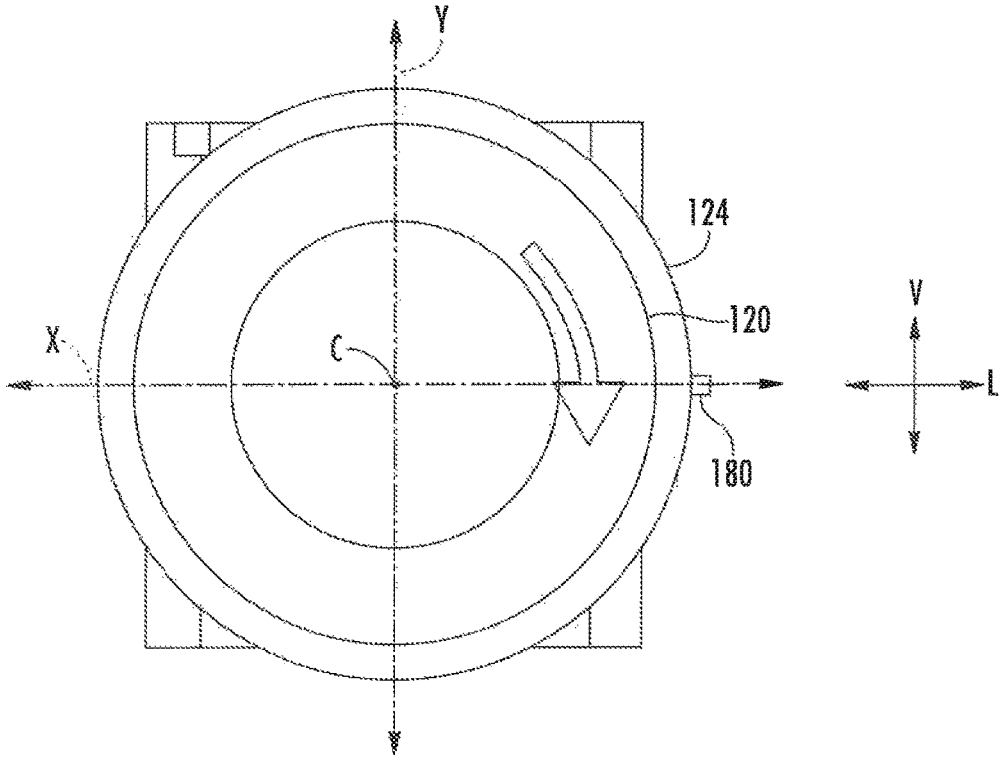
FIG. 6 provides a schematic from view of components of a washing machine appliance in accordance with exemplary embodiments of the present disclosure.

Turning briefly to FIG. 3, wash basket 120, tub 124, and machine drive system 148 are supported by a vibration damping system. The damping system generally operates to damp or reduce dynamic motion imparted to tub 124 as the wash basket 120 rotates within the tub 124. The damping system can include one or more damper assemblies 168 coupled between and to the cabinet 102 and tub 124 (e.g., at a bottom portion of tub 124). Typically, four damper assemblies 168 are utilized, and are spaced apart about the tub 124. For example, each damper assembly 168 may be connected at one end proximate to a bottom corner of the cabinet 102. Additionally or alternatively, the washer can include other vibration damping elements, such as one or more suspension assemblies 170 positioned above wash basket 120 and attached to tub 124 at a top portion thereof. In optional embodiments, the vibration damping system (and washing machine appliance 100, generally) is free of any annular balancing rings, which would add an evenly-distributed rotating mass on basket 120. Thus, the rotating mass of the wash basket 120 may be relatively low, advantageously reducing the amount of energy or torque required to rotate basket 120.

Returning to FIGS. 1 and 2, in some embodiments, washing machine appliance 100 includes an additive dispenser or spout 150. For example, spout 150 may be in fluid communication with a water supply (not shown) in order to direct fluid (e.g., clean water) into tub 124. Spout 150 may also be in fluid communication with the sump 142. For example, pump assembly 144 may direct wash fluid disposed in sump 142 to spout 150 in order to circulate wash fluid in tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during operation of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to tub 124.

In exemplary embodiments, a control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of washing machine appliance 100 is controlled by a controller or processing device 166 that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a washing operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122 and measurement device 180 (discussed herein), may be in communication with controller 166 via one or more signal lines or shared communication busses. Optionally, measurement device 180 may be included with controller 166. Moreover, measurement devices 180 may include a microprocessor that performs the calculations specific to the measurement of motion with the calculation results being used by controller 166.

In exemplary embodiments, during operation of washing machine appliance 100, laundry items are loaded into wash basket 120 through opening 132, and a washing operation is initiated through operator manipulation of input selectors 162. For example, a wash cycle may be initiated such that tub 124 is filled with water, detergent, or other fluid additives (e.g., via additive dispenser 150). One or more valves (not shown) can be controlled by washing machine appliance 100 to provide for filling wash basket 120 to the appropriate level for the volume of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the wash basket 120 may be motivated about the rotation axis A at a set speed (e.g., a tumble speed). As the wash basket 120 is rotated at the tumble speed, articles within the wash basket 120 may be lifted and permitted to drop therein.

After the agitation phase of the washing operation is completed, tub 124 can be drained. Laundry articles can then be rinsed (e.g., through a rinse cycle) by again adding fluid to tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring or shed wash fluid from the articles being washed.

During a spin cycle, basket 120 is rotated at one or more relatively high speeds. For instance, basket 120 may be rotated at one set speed (e.g., an initial speed or pre-plaster speed) before being rotated at another set speed (e.g., a plaster speed). As would be understood, the pre-plaster speed may be greater than the tumble speed and the plaster speed may be greater than the pre-plaster speed. In some such embodiments, the initial or pre-plaster speed is a predetermined rotational velocity while plaster speed is determined based on movement measured at the tub 124 (e.g., horizontal displacement amplitudes detected at a measurement device 180 while wash basket 120 spins at, or increases in speed from, the initial speed). At the determined plaster speed, agitation or tumbling of articles may be reduced as basket 120 increases its rotational velocity such that the plaster speed maintains the articles at a generally fixed position relative to basket 120.

After articles disposed in wash basket 120 are cleaned (or the washing operation otherwise ends), a user can remove the articles from wash basket 120 (e.g., by opening door 134 and reaching into wash basket 120 through opening 132).

Referring now to FIGS. 3 through 6, one or more measurement devices 180 may be provided in the washing machine appliance 100 for measuring movement of the tub 124, in particular during rotation of articles in the spin cycle of the washing operation. Measurement devices 180 may measure a variety of suitable variables that can be correlated to movement of the tub 124. The movement measured by such devices 180 can be utilized to monitor the load balance state of the tub 124 and to facilitate agitation in particular manners or for particular time periods to adjust the load balance state (i.e., as an attempt to balance articles within the wash basket 120).

A measurement device 180 in accordance with the present disclosure may include an accelerometer which measures translational motion, such as acceleration along one or more directions. Additionally or alternatively, a measurement device 180 may include a gyroscope, which measures rotational motion, such as rotational velocity about an axis. A measurement device 180 in accordance with the present disclosure is mounted to the tub 124 (e.g., on a sidewall of tub 124) to sense movement of the tub 124 relative to the cabinet 102 by measuring uniform periodic motion, non-uniform periodic motion, or excursions of the tub 124 during appliance 100 operation. For instance, movement may be measured as discrete identifiable components (e.g., in a predetermined direction).

In exemplary embodiments, a measurement device 180 may include at least one gyroscope or at least one accelerometer. The measurement device 180, for example, may be a printed circuit board that includes the gyroscope and accelerometer thereon. The measurement device 180 may be mounted to the tub 124 (e.g., via a suitable mechanical fastener, adhesive, etc.) and may be oriented such that the various sub-components (e.g., the gyroscope and accelerometer) are oriented to measure movement along or about particular directions as discussed herein. Notably, the gyroscope and accelerometer in exemplary embodiments are advantageously mounted to the tub 124 at a single location (e.g., the location of the printed circuit board or other component of the measurement device 180 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location. For example, a gyroscope located at one location on tub 124 can measure the rotation of an accelerometer located at a different location on tub 124, because rotation about a given axis is the same everywhere on a solid object such as tub 124.

Additionally or alternatively, the measurement device 180 may include another suitable sensor or device for measuring movement of the tub 124. For instance, the measurement device 180 may be provided as or include an optical sensor, an inductive sensor, an ultrasonic sensor, etc.

As illustrated, tub 124 may define an X-axis, a Y-axis, and a Z-axis that are mutually orthogonal to each other. The Z-axis may extend along a longitudinal direction and may thus be coaxial or parallel with the rotation axis A (FIG. 2) (e.g., when the wash tub 124 and basket 120 are balanced). Movement of the tub 124 measured by measurement device (s) 180 may, in exemplary embodiments, be measured (e.g., approximately measured) as a displacement amplitude or value.

In some embodiments, movement is measured as a plurality of unique displacements values. Optionally, the displacement values may occur in discrete channels of motion (e.g., as distinct directional components of movement). For instance, displacement values may correspond to one or more indirectly measured movement components perpendicular or approximately perpendicular to a center C (e.g., geometric center of gravity based on the shape and mass of tub 124 in isolation) of the tub 124. Such movement components may, for example, occur in a plane defined by the X-axis and Y-axis (i.e., the X-Y plane) or in a plane perpendicular to the X-Y plane. Movement of the tub 124 along the particular direction may be calculated using the indirect measurement component and other suitable variables, such as a horizontal or radial offset distance along the vector from the measurement device 180 to the center C of the tub 124. Additionally or alternatively, the displacement values may correspond to one or more directly measured movement components. Such movement components may, for example, occur in the X-Y plane or in a plane perpendicular to the X-Y plane.

The measured movement of the tub 124 in accordance with exemplary embodiments of the present disclosure, such as those requiring one or more gyroscopes and one or more accelerometers, may advantageously be calculated based on the movement components measured by the accelerometer or gyroscope of the measurement device(s) 180. For example, a movement component of the tub 124 may be a linear displacement vector $P_{XB}$ (e.g., a first displacement vector) of center C in the X-Y plane (e.g., along the lateral direction L). Displacement vector $P_{XB}$ may be calculated from detected movement by the accelerometer at measurement device 180 (e.g., via double integration of detected acceleration data). For example, vectors defined in an X-Y plane such as $P_{XB}$ may represent the radius of a substantially circular (e.g., elliptical, orbital, or perfectly circular) motion caused by the rotation of wash basket 120 at an initial or pre-plaster speed so that maximum and minimum values of the periodic vector occur as the substantially circular motion aligns with the direction of the vector.

Figure 8:
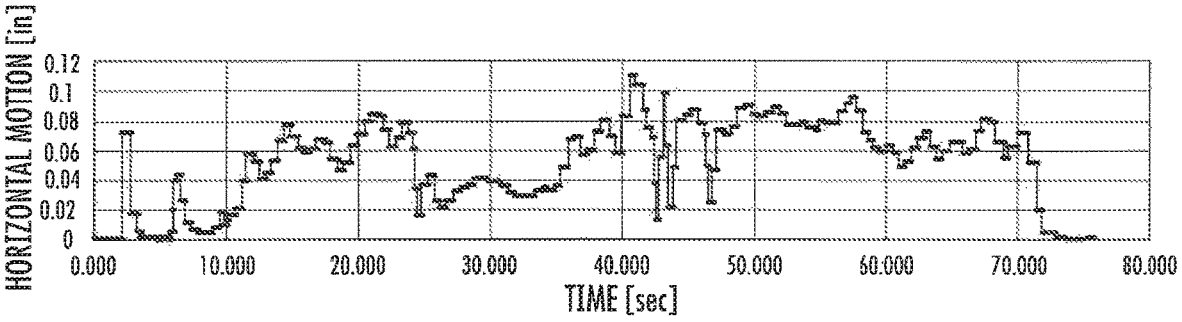
FIG. 8 provides an exemplary measurement chart illustrating horizontal tub motion (i.e., horizontal displacement) over time at a first wash basket velocity.
Figure 9:
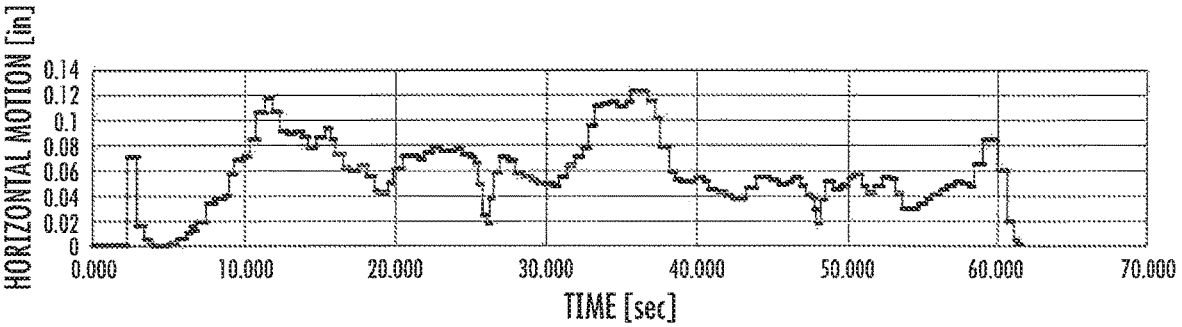
FIG. 9 provides an exemplary measurement chart illustrating horizontal tub motion (i.e., horizontal displacement) over time at a second wash basket velocity.
Figure 10:
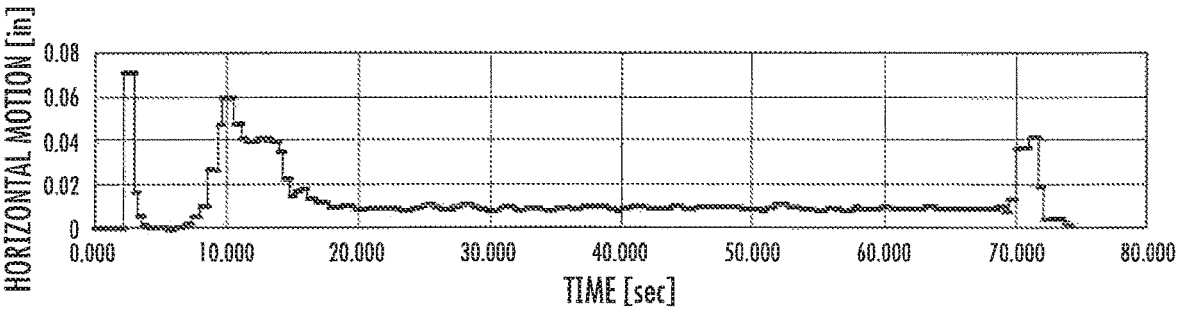
FIG. 10 provides an exemplary measurement chart illustrating horizontal tub motion (i.e., horizontal displacement) over time at a third wash basket velocity.

Turning briefly to FIGS. 8 through 10, or some of motion may be tracked as a plurality of amplitudes (e.g., horizontal motion) that are measured over time. Generally, FIGS. 8 through 10 illustrate recorded measurements taken while spending a wash basket at a first speed (e.g., first pre-plaster speed—FIG. 8), a second speed (e.g., second pre-plaster speed—FIG. 9), and a third speed (e.g., plaster speed—FIG. 10). Moreover, the third speed may be greater than the second speed, and the second speed may be greater than the first speed. In some embodiments, washing machine appliance 100 (FIG. 1) records each horizontal maximum detected at measurement device 180 (FIG. 3) as a new or unique amplitude (e.g., deviation from a static home position). As illustrated, multiple displacement amplitudes may be measured over time (e.g., during a predetermined time period within the spin cycle). Moreover, reaching a plaster speed may generally result in a reduced change in amplitude (e.g., such that a sloped defined by the recorded or tracked amplitudes is approximately zero).

Returning to FIGS. 3 through 6, in additional or alternative embodiments, another movement component of tub 124 is obtained at measurement device 180. For instance, a wobble angle $\phi_{YY}$ of angular displacement of the tub 124 may be calculated. Wobble angle $\phi_{YY}$ may represent rotation relative to the rotation axis A (FIG. 2) such as the angle of deviation of the Z-axis from its static or balanced position around the rotation axis A. Wobble angle $\phi_{YY}$ may be calculated as a rotation parallel to the Y-axis using movement detected by the gyroscope at measurement device 180 (e.g., via integration of detected rotational velocity data).

In still further additional or alternative embodiments, a movement component of tub 124 may be a linear displacement vector $P_{XT}$ (e.g., a second displacement vector) of a center C' (e.g., effective center of gravity that compensates for biasing or resistance forces on tub 124 from one or more directions) in a plane parallel to the X-Y plane and perpendicular to the rotation axis A (FIG. 2) (e.g., along the lateral direction L). Displacement vector $P_{XT}$ may thus be separated from the displacement vector $P_{XB}$ along the Z-axis. Optionally, the vector $P_{XT}$ may be calculated from movement detected at the accelerometer or gyroscope at measurement device 180. For example, displacement vector $P_{XT}$ may be calculated as a cross-product (e.g., the rotation at $\phi_{YY}$ times the transverse offset distance between measurement device 180 and C') added to another displacement vector (e.g., $P_{XB}$).

Further, and as discussed, the measurement device 180 need not be in the X-Y plane in which movement (e.g., at the center C) is calculated. For example, measurement device 180 may additionally be offset by an offset distance along the Z-axis. In one particular example, a measurement device 180 mounted to or proximate a suspension assembly 170 may be utilized to indirectly measure movement of the center C in an X-Y plane at or proximate the top of the tub 124. Additionally or alternatively, a measurement device 180 can be mounted close to or on the Z-axis or may be used to calculate motion that is not on the rotation axis A (FIG. 2).

Figure 7:
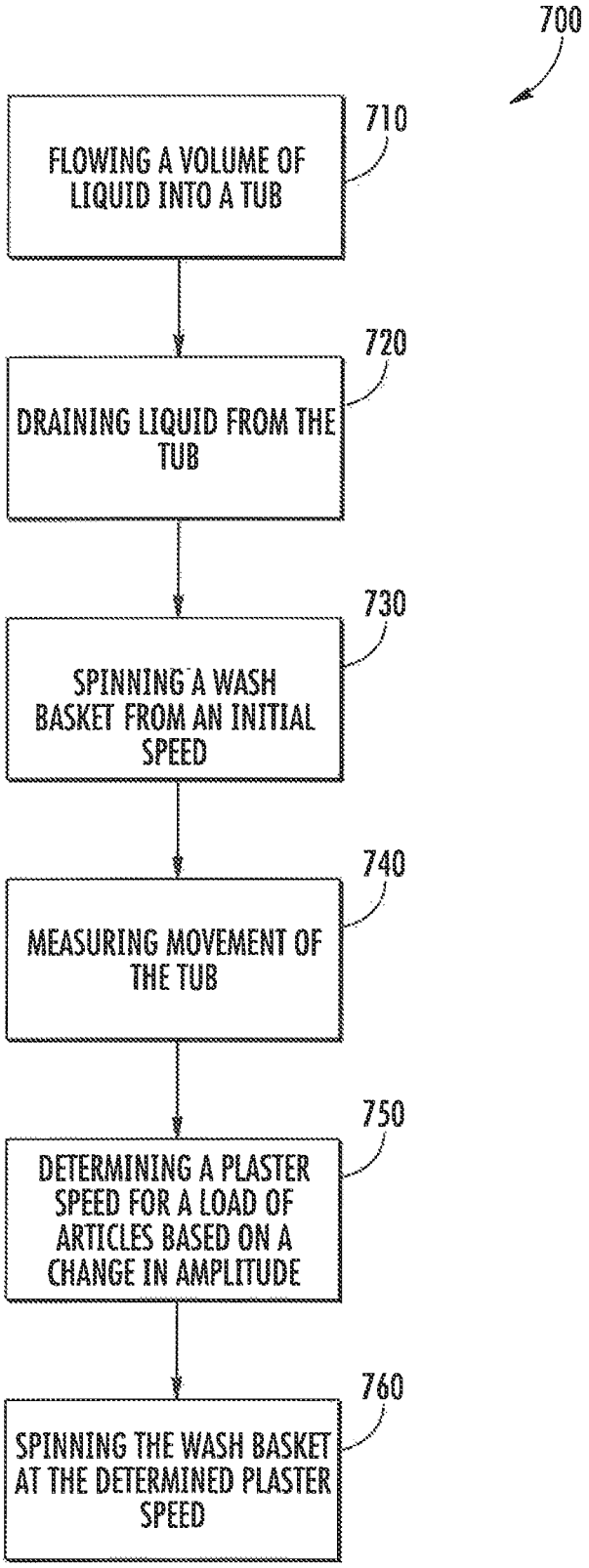
FIG. 7 provides a flow chart illustrating a method for operating a washing machine appliance in accordance with embodiments of the present disclosure.

Referring now to FIG. 7, various methods may be provided for use with washing machine appliances in accordance with the present disclosure. In general, the various steps of methods as disclosed herein may, in exemplary embodiments, be performed by the controller 166, which may receive inputs and transmit outputs from various other components of the appliance 100. In particular, the present disclosure is further directed to methods, as indicated by reference number 700, for operating a washing machine appliance 100. Such methods advantageously facilitate improved performance (e.g., shedding of wash fluid from articles during the spin cycle) or efficiency (e.g., such that excessive speeds are not reached during a spin cycle) of washing machine appliance 100. Moreover, such methods may advantageously provide a direct, real time evaluation and response to conditions of a given load.

At 710, the method 700 includes flowing a volume of liquid into the tub. The liquid may include water, and may further include one or more additives as discussed above. The water may be flowed through hoses, tubes, or the nozzle assembly into the tub and onto articles that are disposed in the wash basket for washing. The volume of liquid may be dependent upon an initial load size estimate or other variables that may, for example, be input by a user interacting with control panel and input selectors thereof.

At 720, the method 700 includes draining liquid from the tub. The pump assembly may be activated such that water is motivated out of the tub, as discussed above. Generally, 720 follows 710 (i.e., 720 is performed subsequent to 710). However, as would be recognized, one or more additional steps or cycles (e.g., agitation cycle, wash cycle, rinse cycle, etc.) may be performed between 710 and 720.

At 730, the method 700 includes spinning the wash basket from an initial speed ω1) after draining liquid from the tub. In other words, the wash basket may be rotated from a substantially static state (e.g., wherein the motor assembly is not spinning or rotating the wash basket) to a rotated state (e.g., wherein the motor assembly is activated and is spinning the wash basket about the rotation axis) as liquid begins to shed from articles within the load. Optionally, 730 may follow or at least partially coincide with 720. Additionally or alternatively, the spinning at 730 may begin after the pump assembly is activated at 720 and continue while the pump assembly drains the liquid (e.g., water or wash fluid) from the tub.

At 730, the wash basket at least reaches a rotational velocity about the rotation axis that is equal to the initial speed. Generally, the initial speed (ω1) may be a predetermined speed (e.g. pre-plaster speed) stored within the controller of the washing machine appliance. Moreover, the initial speed may be a relatively high speed that is, for instance, greater than a tumble speed for the washing machine appliance. Optionally, 730 may include spinning the wash basket at the initial speed for a predetermined initial time period.

In some embodiments, 730 includes ramping the wash basket from the initial speed (ω1) to a second speed (ω2) that is greater than the initial speed (i.e., ω2>ω1). In other words, the rotational velocity of the wash basket may be increased from the initial speed (ω1) to the second speed (ω2). Optionally, the ramping or increasing in speed may be a steady, continuous increase (e.g., linear increase). Alternatively, the ramping or increasing in speed may be an indexed increase. In other words, the rotational velocity may increase in predefined increments (e.g., in units of velocity), such that each new indexed velocity is sustained for a preset amount of time. The increase in speed from the initial speed (ω1) to the second speed (ω2) may thus resemble a step function.

At 740, method 700 includes measuring movement of the tub. Specifically, movement of the tub may be measured following spinning the wash basket from the initial speed. In other words, 740 may begin after the wash basket has reached the initial speed. Moreover, 740 may continue as the wash basket spins (e.g., during at least a portion of 730) such that movement is measured at the initial speed.

As discussed above, measuring movement may include detecting movement of the tub as a plurality of amplitudes (e.g. horizontal amplitudes using a measurement device, described above). Thus, 740 may include detecting movement of the tub as a plurality of (e.g., horizontal displacement) amplitudes caused by the rotation of the wash basket within the tub. For example, 740 may occur during 730, during a predetermined time period, during a predefined portion of a spin cycle, or at another suitable period. Using the plurality of amplitudes, 740 may further include evaluating a change in amplitude (e.g., change over time). In other words, the change in amplitude may be evaluated from, and based on, the plurality of detected amplitudes.

In some such embodiments, evaluating the change in amplitude includes recording a number of discrete amplitudes ($N_T$) (i.e., the total number of displacement amplitudes within the plurality of amplitudes of 740). For instance, ($N_T$) may be recorded for the period of time in which the wash basket is ramping from the first speed (ω1) to the second speed (ω2). Thus, a total number of discrete amplitudes may be recorded as ($N_T$) to indicate how many amplitudes have been measured during the step of ramping the wash basket from the first speed (ω1) to the second speed (ω2). Once the number of discrete amplitudes ($N_T$) has been recorded, evaluating the change in amplitude may further include calculating a difference between each pair of sequential amplitudes of the plurality of amplitudes. In other words, the difference ($\Delta A_i$) between one amplitude ($A_N$) and its immediate successor ($A_{N+1}$) may be calculated between each of the plurality of amplitudes (i.e., $\Delta A_i = A_N - A_{N+1}$). After the difference ($\Delta A_i$) is calculated, the sign (i.e., positive/negative sign indicating whether the difference ($\Delta A_i$) is a positive or negative value) may be recorded. In some such embodiments, the sign of each difference (e.g., $\Delta A_i$, $\Delta A_{i+1}$, $\Delta A_{i+2}$, etc.) is recorded as an amplitude variation set. For instance, the amplitude variation set may be provided as a set of positive/negative signs (e.g., +, +, −, etc.) ordered according to the corresponding differences (e.g., $\Delta A_i$, $\Delta A_{i+1}$, $\Delta A_{i+2}$, etc.). Moreover, from the amplitude variation set, a maximum number of consecutive signs ($N_{max}$) may be determined or recorded. In other words, the maximum number of repeated positive signs or negative signs may be determined or recorded as ($N_{max}$).

In additional or alternative embodiments, evaluating the change in amplitude includes tracking a slope of the change in amplitude over time. For instance, measured movement may be charted or graphed as the plurality of amplitudes over time. From such a chart or graph, the slope of the line connecting the plurality of amplitudes may be determined or recorded (e.g., continuously as movement is measured).

In further additional or alternative embodiments, evaluating the change in amplitude includes tracking a running average of the change in amplitude over time. For instance, as movement is being measured, the difference ($\Delta A_i$) between pairs of sequential amplitudes may be determined and combined with any previous differences (e.g., $\Delta A_{i-1}$) to calculate an average or mean value ($\Delta A_{avg}$). Each new difference (e.g., $\Delta A_{i+1}$) may then be used to update the average or mean value ($\Delta A_{avg}$) such that ($\Delta A_{avg}$) provides an average or mean value for all of the differences in amplitude (e.g., $\Delta A_{i-1}$ $\Delta A_i$ $\Delta A_{i+1}$) at a given moment. Moreover, evaluating the change may further require calculating the difference ($\Delta A_C$) between the running average ($\Delta A_{avg}$) and a specific change in amplitude ($\Delta A_i$) (i.e., $\Delta A_C = \Delta A_{avg} - \Delta A_i$). Optionally, a calculation of the difference ($\Delta A_C$) may be made each time a new amplitude ($A_{N+1}$) is determined.

At 750, the method 700 includes determining a plaster speed for the load of articles based on the change in amplitude evaluated at 740. The plaster speed of the washing operation is advantageously contingent upon the actual measured movement and change in amplitude for a particular washing operation.

As an example, 750 may include calculating the plaster speed (e.g., as a specific value of rotational velocity for the wash basket) utilizing a predetermined formula. In some such embodiments, the predetermined formula is a function of the maximum number of consecutive signs ($N_{max}$) of the amplitude variation set and the number of discrete amplitudes ($N_T$). In additional or alternative embodiments, the predetermined formula is a function of a difference in the second speed (ω2) and the initial speed (ω1). For instance, the plaster speed ($\omega_p$) may be calculated as the second speed (ω2) minus the product of difference in the second speed (ω2) and the initial speed (ω1) times the maximum number of consecutive signs ($N_{max}$) over the number of discrete amplitudes ($N_T$) [i.e., $\omega_p = \omega 2 - (N_{max}/N_T)*(\omega 2 - \omega 1)$].

As another example, if the slope of the change in amplitude over time is tracked, 750 may include determining the plaster speed ($\omega_p$) in response to the slope equaling approximately zero. In certain embodiments, the plaster speed ($\omega_p$) is identified as rotational velocity achieved by the wash basket at the moment (i.e., moment in time) in which the slope of the change in amplitude over time is approximately zero. In other words, 750 may identify that the articles within the load have reached a plastered state by the change in amplitude over time reaching approximately zero.

As yet another example, if the running average of the change in amplitude over time is tracked, 750 may include determining the plaster speed ($\omega_p$) in response to the difference ($\Delta A_C$) between a running average ($\Delta A_{avg}$) and the change in amplitude over time ($\Delta A_i$) equaling approximately zero (i.e., $\Delta A_C = 0$). In certain embodiments, the plaster speed ($\omega_p$) is identified as rotational velocity achieved by the wash basket at the moment (i.e., moment in time) in which the difference ($\Delta A_C$) is approximately zero. In other words, 750 may identify that the articles within the load have reached a plastered state by the difference ($\Delta A_C$) reaching approximately zero.

At 760, the method 700 includes spinning the wash basket at the determined plaster speed. For instance, 760 may be performed over a predefined plaster period. The plaster period may be a predefined period of time programmed into the controller or an indeterminate period continued until a subsequent step is initiated. Generally, the plaster speed is greater than the pre-plaster speed and is generally suitable to plaster articles of a particular load within the tub to the walls of the wash basket and encourage the shedding of liquid (e.g., water or wash fluid) from the articles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance having a tub and a wash basket rotatably mounted within the tub, the wash basket to receive a load of one or more articles, the method comprising:

flowing a volume of liquid into the tub;

draining liquid from the tub;

spinning the wash basket from an initial speed after draining liquid from the tub;

measuring movement of the tub following spinning the wash basket at the initial speed, wherein measuring movement comprises detecting movement of the tub as a plurality of amplitudes, and evaluating a change in amplitude from the plurality of amplitudes;

determining a plaster speed for the load of one or more articles based on the change in amplitude; and spinning the wash basket at the determined plaster speed, wherein spinning the wash basket from the initial speed comprises ramping the wash basket from the initial speed to a second speed, the second speed being greater than the initial speed, and wherein evaluating a change in amplitude comprises recording a number of discrete amplitudes during ramping the wash basket from the initial speed to the second speed, calculating a difference between each pair of sequential amplitudes of the plurality of amplitudes, recording a sign of each difference as an amplitude variation set, and determining a maximum number of consecutive signs of the amplitude variation set.

2. The method of claim 1, wherein determining the plaster speed comprises calculating the plaster speed utilizing a predetermined formula, the predetermined formula being a function of the maximum number of consecutive signs of the amplitude variation set and the number of discrete amplitudes.

3. The method of claim 2, wherein the predetermined formula is further a function of a difference in the second speed and the initial speed.

4. The method of claim 3, wherein the predetermined formula is provided as:

$$\omega_p=\omega_2-(N_{max}/N_T)*(\omega_2-\omega_1)$$

wherein $\omega_p$ is the plaster speed, wherein ω1 is the initial speed, wherein ω2 is the second speed, wherein $N_{max}$ is the maximum number of consecutive signs of the amplitude variation set, and wherein $N_T$ is the number of discrete amplitudes.

5. The method of claim 1, further comprising indexing spin speed at a predetermined interval from the initial speed while measuring movement of the tub.

6. The method of claim 5, wherein measuring movement further comprises tracking a slope of the change in amplitude over time; and wherein the plaster speed is determined in response to the slope of the change in amplitude over time equaling approximately zero.

7. The method of claim 5, wherein measuring movement further comprises tracking a running average of the change in amplitude over time, and calculating a difference between the running average and the change in amplitude; and wherein the plaster speed is determined in response to the difference between the running average and the change in amplitude equaling approximately zero.

8. A washing machine appliance, comprising:

a tub;

a wash basket rotatably mounted within the tub to receive a load of one or more articles;

a valve;

a nozzle configured for flowing liquid from the valve into the tub;

a measurement device to detect movement of the tub;

a motor in mechanical communication with the wash basket, the motor configured for selectively rotating the wash basket within the tub; and a controller in operative communication with the valve, the motor, and the measurement device, the controller being configured to initiate a washing operation, the washing operation comprising flowing a volume of liquid into the tub;

draining liquid from the tub;

spinning the wash basket from an initial speed after draining liquid from the tub;

measuring movement of the tub following spinning the wash basket at the initial speed, wherein measuring movement comprises detecting movement of the tub as a plurality of amplitudes at the measurement device, and evaluating a change in amplitude from the plurality of amplitudes;

determining a plaster speed for the load of one or more articles based on the change in amplitude; and spinning the wash basket at the determined plaster speed, wherein spinning the wash basket from the initial speed comprises ramping the wash basket from the initial speed to a second speed, the second speed being greater than the initial speed, and wherein evaluating a change in amplitude comprises recording a number of discrete amplitudes during ramping the wash basket from the initial speed to the second speed, calculating a difference between each pair of sequential amplitudes of the plurality of amplitudes, recording a sign of each difference as an amplitude variation set, and determining a maximum number of consecutive signs of the amplitude variation set.

9. The washing machine appliance of claim 8, wherein determining the plaster speed comprises calculating the plaster speed utilizing a predetermined formula, the predetermined formula being a function of the maximum number of consecutive signs of the amplitude variation set and the number of discrete amplitudes.

10. The washing machine appliance of claim 9, wherein the predetermined formula is further a function of a difference in the second speed and the initial speed.

11. The washing machine appliance of claim 10, wherein the predetermined formula is provided as:

$$\omega_p=\omega_2-(N_{max}/N_T)*(\omega_2-\omega_1)$$

wherein $\omega_p$ is the plaster speed, wherein ω1 is the initial speed, wherein ω2 is the second speed, wherein $N_{max}$ is the maximum number of consecutive signs of the amplitude variation set, and wherein $N_T$ is the number of discrete amplitudes.

12. The washing machine appliance of claim 8, wherein the washing operation further comprises indexing spin speed at a predetermined interval from the initial speed while measuring movement of the tub.

13. The washing machine appliance of claim 12, wherein measuring movement further comprises tracking a slope of the change in amplitude over time; and wherein the plaster speed is determined in response to the slope of the change in amplitude over time equaling approximately zero.

14. The washing machine appliance of claim 13, wherein measuring movement further comprises tracking a running average of the change in amplitude over time, and calculating a difference between the running average and the change in amplitude; and wherein the plaster speed is determined in response to the difference between the running average and the change in amplitude equaling approximately zero.

* * * * *